is actuated to extend the cylinder rod 106 from the cylinder 105, so as to advance the claw 107, thereby to retain the belt 28 by the claw 107. The claw 107 then ejects the belt 28, out of the twisted-belt ejecting means 36, through the notches 76 and 72 of the rail 77 and the frame 73.

Then, the cylinder 105 is reversed to retract the cylinder rod 106, so as to reset the claw 107.

Then, the cylinder 105 is reversed to retract the cylinder rod 106, so as to reset the claw 107. Meanwhile, as the belt 28 has been lifted up to the guiding surface of the rails 75, 77 by the claw 89, the fifth sensor 108 detects the leaving of the belt 28. After an elapse of a time since the detection of the leaving of the belt 28 by the fifth sensor 108 until the resetting of the claw 89, the output from the fifth sensor 108 then acts to start the motors 56 and 63, so as to drop the belt 28 stationed at the discharging end of the shaft 66 to drop therefrom. The belt 28 is then retained by the claw 89.

When no belt has not arrived at the supporting plate 95, i.e. when the absence of the belt 28 is sensed by the eleventh sensor 114, even after the above stated operation, the operation is repeated after the presence of the belt 28 is detected by the fifth sensor 108 subsequent to the ejecting operation.

When the belt safely arrives at the supporting plate 95, the arrival is detected by the eleventh sensor 114. When the eleventh and fifth sensors 114 and 108 detects the belts 28, while the tenth sensor 110 detects no belt 28, the solenoids 84 to 87 are energized to repeat the described operation, until the tenth sensor 113 comes to detect the belt 28. When the eleventh, tenth and fifth sensors 114, 113 and 108 detect the belts 28, while the ninth sensor 112 does not, the solenoids 84 to 86 are energized to repeat the above stated operation until the ninth sensor 112 comes to detect the belt 28. Further, when the eleventh, tenth, ninth and fifth sensors 114, 113, 112 and 108 detect the belts 28 while the eighth sensor 111 does not, the solenoids 84, 85 are energized to repeat the same operation until the eighth sensor 111 comes to detect the belt 28. Still further, when the eleventh to eighth sensors 114 to 111, as well as the fifth sensor 108, detect the belts 28 while the sixth sensor 109 does not, the solenoid 84 is solely energized by repeat the operation until the sixth sensor 109 comes to detect the belt 28.

Meanwhile, as the eleventh sensor 114 detects the arrival of the belt 28, the cylinder 167 of the pick-and-place unit 38 is actuated to lower the chuck 37, which is carried by the adapter plate 170 and has been stationed at a position above the supporting plate 95, until the claws 141, 142, 144 of the chuck 37 comes into contact with the supporting plate 95. As these claws 141, 142, 144 of the chuck 37 has come into contact with the supporting plate, the cylinder 147 is started to extend its cylinder rod 147, so as to move the slider 132 through the fixing plate 150 toward the rotary arm 124. As a result of the movement of the slider 132, the rocking arms 122, 123 are rotated, through the levers 128, 129, around respective pins 135, 135', in the direction to stretch the belt 28. Simultaneously, the pinion 145 is rotated through the rack 146 fixed to the slider 132, so as to rotate the rotary arm 124 in the direction to stretch the belt 28. Then, the rocking arms 122, 123 and the rotary arm 124 hold the belt 28, through their claws 141, 142 and 144, stretching the same radially outwardly. Since the claws 141, 142, 144 are carried by respective arms through respective bearings 140, 143, for free rotation, the belt 28 is held with an uniform tension over the entire circumference thereof.

As the belt 28 is held by the chuck 37, the cylinder 167 is reversed to lift the chuck 37 up to the position above the supporting plate 95. As the chuck 37 has been lifted up to the uppermost position in its vertical stroke, the cylinder 163 is actuated to move the chuck 37 to the position above the fitting position. Meanwhile, the article 27 to which the belt 28 is to be fitted has been conveyed along the guiding rail 171 of the conveying means 39, by the feeding claws, and has been stationed at the predetermined fitting position. As the chuck 37 reaches the position above the fitting position, the cylinder 147 is energized to lower the chuck 37, until the belt 28 held by the chuck 37 comes down to the level confronting the peripheries of the pulleys 29, 30 of the article 27. As the chuck 37 has arrived at the lowered position and stationed, the cylinder 147 of the chuck 37 is energized again to retract the cylinder rod 149, so as to pull back the slider 132 through the fixing plate 150. Consequently, the rocking arms 122 and 123 are swung toward the center of the belt 28, through the pair of levers 128, 129, while the rotary arm 144 is rotated also toward the center of the belt 28, through the rack 146 and pinion 145. Consequently, the claws 141, 142 and 144 are all concentrated to the space between the pulleys 29 and 30, so that the belt 28 comes to be retained by the peripheries of the pulleys 29, 30, i.e. the belt 28 is fitted around the article 27.

During this fitting, no excessive tension is applied to the belt 28, due to the rotatable nature of the claws 141, 142, 144, so that the belt 27 is fitted without being deformed.

After fitting of the belt 28 around the article 27, the cylinder 147 is reversed to raise the chuck 37 to the position above the fitting position. Subsequently, the cylinder 163 is actuated to retract the chuck 37 to the position above the supporting plate 95.

Meanwhile, the article 27 to which the belt 28 has been fitted is forwarded to the subsequent step of process, by the feeding claw 177 which is actuated through the fixture 174 and the slider 175 by the cylinder rod 173 of the cylinder 170.

The cylinder 172 retracts its cylinder rod 173, after having conveyed the article 27 by a predetermined distance, so as to reset the slider 175. During the returning movement of the slider, the feeding claws abutting the article 27 is depressed by the latter, against the biasing force of the spring 176, so as not to displace the article 27.

The belts 28 are successively fitted around the successive articles 27, as the described operation is performed repeatedly.

The foregoing description has been made as to the handling of belts having a rectangular cross-section. However, the described apparatus can be used for belts having a round cross-section. In the latter case, the twisted-belt ejecting means 36 cannot eject rejected belts and, therefore, acts merely as guide means for guiding the belts from the shifting end of the shifting means 35 to the supporting plate 95.

What is claimed is:

1. An apparatus for fitting a flexible annular part around an article comprising:

(a) separating means including a rotary drum mounted for rotation about a horizontally positioned axis and having a plurality of pins formed on an inner peripheral wall of said drum, said pins Fig. 3A
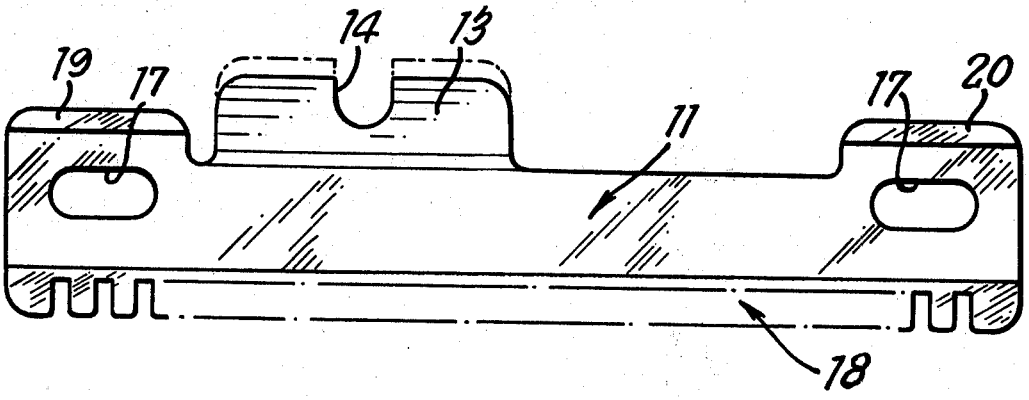
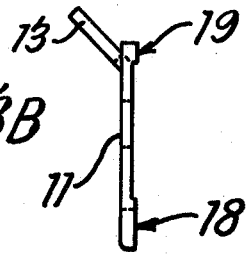
Fig. 3B
Fig. 4A
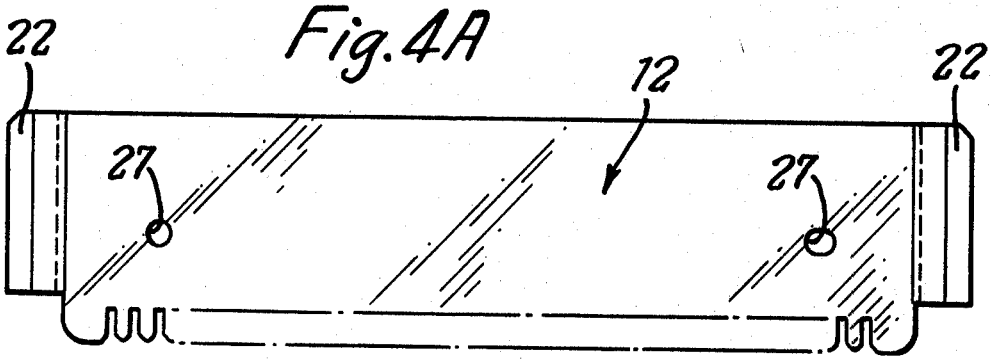
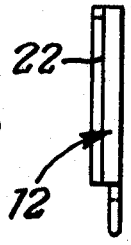
Fig. 4B

HAIR CLIPPERS

BACKGROUND OF THE INVENTION

This invention relates to hair clippers. Hair clippers may be incorporated in other appliances such as ac or battery powered electric dry shavers, where they are sometimes referred to as long hair trimmers, or may be separate appliances.

FIELD OF THE INVENTION

In certain presently available electric dry shavers a long hair trimmer is provided comprising first and second mutually slidingly reciprocable toothed cutters. Both cutters are rectilinear, one being fixed and the other movable, and the movable cutter is urged against the fixed cutter by means of a number of coil springs. Both cutters are substantially rigid but there is a size, weight and power consumption limit to the rigidity that can be given to the cutters. Consequently it has been found that the cutters can bow to some extent, and thus to achieve an effective cutting action at points between the springs, the force of the springs has to be increased such that the cutters are pressed together to a greater extent than necessary in the neighbourhood of the springs. The efficiency is thereby reduced and the power consumption increased.

An object of the invention is to provide a hair clipper of improved efficiency consistent with an effective clipping action.

SUMMARY OF THE INVENTION

According to the present invention there is provided a hair clipper comprising first and second mutually slidingly reciprocable and inherently slightly resilient toothed cutters resiliently urged to assume a similar curvature to one another along the direction of reciprocation to tend to render uniform the pressure distribution therebetween.

More particularly, the invention provides a hair clipper comprising first and second toothed cutters adapted to be driven in relative sliding reciprocation to effect a cutting action, wherein both cutters are inherently slightly resilient, wherein resilient means acts on the first cutter to urge it against the second cutter, wherein reaction means acts on the second cutter to oppose the force due to said resilient means, and wherein said resilient means and said reaction means provide a force couple that imparts a similar curvature to both cutters along the direction of reciprocation, whereby to tend to render uniform the pressure distribution between the two urged together cutters.

The resilient means may comprise at least one spring acting on the first cutter intermediate its ends, and the reaction means may include substantially non-resilient reaction structure acting on each end portion of the second cutter.

In one embodiment the first cutter is adapted to be driven in sliding reciprocation, and means is provided to locate the second cutter in position longitudinally and laterally while permitting it to curve resiliently to assume a similar curvature to the first cutter. Said locating means may include at least one piston working in a bore in the shaver body and urged into engagement with the second cutter to act thereon away from the first cutter and against said reaction means. Said piston may pass through a slot in the first cutter and thus also serve to locate the first cutter laterally and to guide the first cutter in its longitudinal reciprocation.

In another embodiment, the substantially non-resilient reaction structure comprises a pair of pins near opposite ends of the second cutter, the pins also serving to locate the second cutter longitudinally and laterally, and furthermore to locate the first cutter laterally and to guide it in its longitudinal reciprocation.

The result of tending to render uniform the pressure distribution between the cutters is to provide an effective or improved cutting action with greater efficiency and thus at reduced power consumption. With an effective cutting action the comfort of the user is enhanced and hair pulling during clipping is minimized. In a battery powered electric dry shaver it is important that the power consumption of the clipper is as low as possible consistent with an effective cutting action. When a clipper is driven by an AC reluctance motor the amplitude of clipper reciprocation decreases if the mechanical power consumed by the clipping action increases, thus decreasing the effectiveness of the cutting action, and therefore again it is important to increase the clipper efficiency.

BRIEF DESCRIPTION OF DRAWINGS

An embodiment of the invention will now be described, by way of example, with reference to the accompanying drawings, in which:

FIGS. 3A and 3B are a top plan and an end view respectively of the movable cutter of the clipper;

FIGS. 4A and 4B are a top plan and an end view respectively of the fixed cutter of the clipper;

DESCRIPTION OF PREFERRED EMBODIMENT

Figure 1:
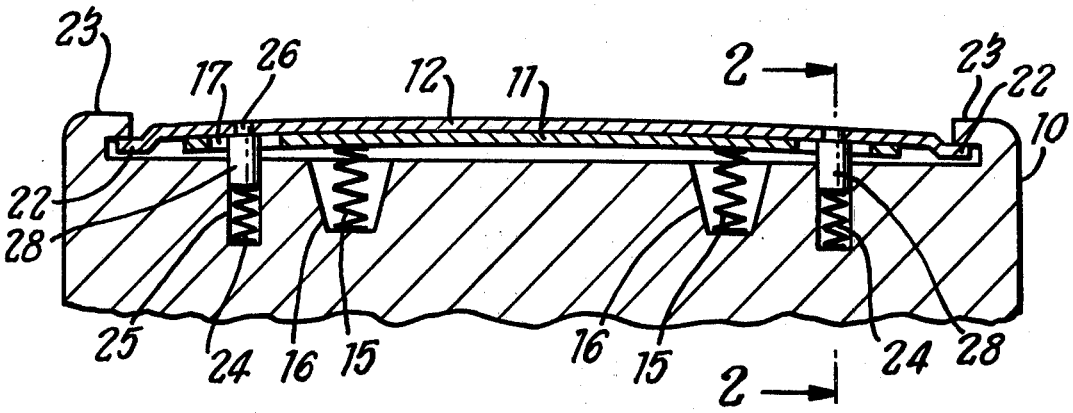
FIG. 1 is a longitudinal section, partly broken away, through a hair clipper according to the invention.
Figure 2:
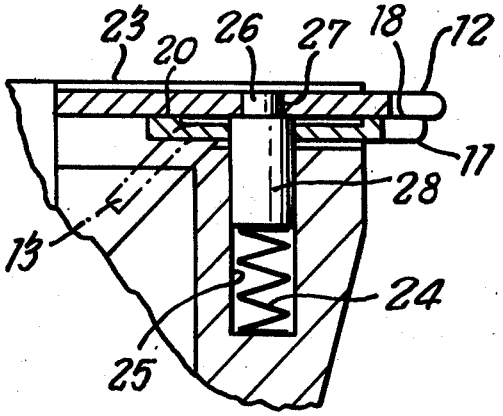
FIG. 2 is a scrap section on an enlarged scale on line 2—2 of FIG. 1.

Referring to the drawings there is shown a hair clipper, sometimes referred to as a long hair trimmer, incorporated in a AC or battery powered electric dry shaver, a portion of the body of the shaver being shown at 10. The clipper comprises a first elongate movable toothed cutter 11 and a second substantially fixed elongate toothed cutter 12. The first cutter 11 is adapted to be driven in sliding longitudinal reciprocation relative to the second cutter 12 to effect a cutting action. To this end the rear edge of the cutter 11 is provided with an obliquely bent tab 13 provided with a notch 14. In use a reciprocating element of the shaver drive mechanism is engaged in the notch 14 to reciprocate the cutter 11. Such drive mechanism is not shown but a number of suitable mechanisms are currently available in the dry shaver art. The drive mechanism would normally be under control of a switch for selective operation of the clipper when required.

The area of mutual sliding contact between the two cutters in use is shown on cutter blade 11 as the longitudinal forward toothed strip portion 18 and the two longitudinally spaced strip portions 19, 20 at the rear edge of cutter 11, as shown in FIGS. 3A and 3B.

The cutters are each inherently slightly resilient along their length. A number of metals are suitable for forming cutter teeth and most of such metals would also exhibit sufficient inherent resilience for the purpose of this invention, thereby permitting the teeth to be integrally formed along the forward edges of the respective cutters. A preferred material is a stainless tempered steel.

The first, movable cutter 11 is resiliently urged against the second cutter by resilient means in the form of two spaced coil springs 15 received in frusto-conical recesses 16 in the body 10 of the shaver. During reciprocation the springs 15 can tilt from side to side in their recesses 16 to follow the cutter reciprocation. The springs 15 act on cutter 11 substantially midway between the centre of the length of the cutter 11 and its end. The cutter 11 is located laterally and guided in its longitudinal reciprocation by means of two pistons 28, to be described below, extending through slots 17 formed near the end portions of the cutter 11.

The second, fixed cutter 12 has set-back end portions 22 trapped beneath flanges 23 formed on the body 10 of the shaver. Two spaced coil springs 24 are received in respective bores 25 in the body 10. The springs 24 act on the respective pistons 28 which work in and extend partially from the bores 25. The outward ends of the pistons 28 are provided with studs 26 fitted into bores 27 through the second cutter 12. The pistons 28 and springs 24 are located between the springs 15 and the end portions 22 of the second cutter 12. The pistons 28 thus urge the end portions 22 against the flanges 23, to locate the second fixed cutter 12 in position longitudinally and laterally, while permitting the cutter 12 to curve between its ends to assume a similar curvature to the first cutter 11, as imposed by the first cutter 11 under the action of the springs 15.

It will be appreciated that the flanges 23 serve as substantially non-resilient reaction structure opposing the major action of the two springs 15 and the minor action of the two springs 24. In FIG. 1, the left-hand structure 23 and spring 15 form a first force couple and the right-hand structure 23 and spring 15 form a second force couple, both couples acting similarly to resiliently urge the cutters to assume a similar upward curvature to one another along the direction of reciprocation.

It is found that the action of the couples in causing the cutters to assume a similar curvature to one another together with the inherent slight resilience of the cutters themselves tends to render uniform the pressure distribution between the two urged together cutters. The pressure distribution is found to be more nearly uniform than in the case of two substantially rigid rectilinear cutters. In consequence the total force between the cutters can be reduced, the cutting action efficiency is improved, and the power consumption considerably reduced. For example in one embodiment the total force between the cutters was 300 grams.

The clipper in the embodiment of FIGS. 1 to 4 may also be readily and quickly assembled. The springs and pistons are dropped in their recesses, the movable blade 11 located over the pistons, and the end portions 22 of the fixed blade 12 are then slid beneath the flanges 23, perpendicular to the plane of FIG. 1, until the studs 26 enter into the bores 27.

Figure 5:
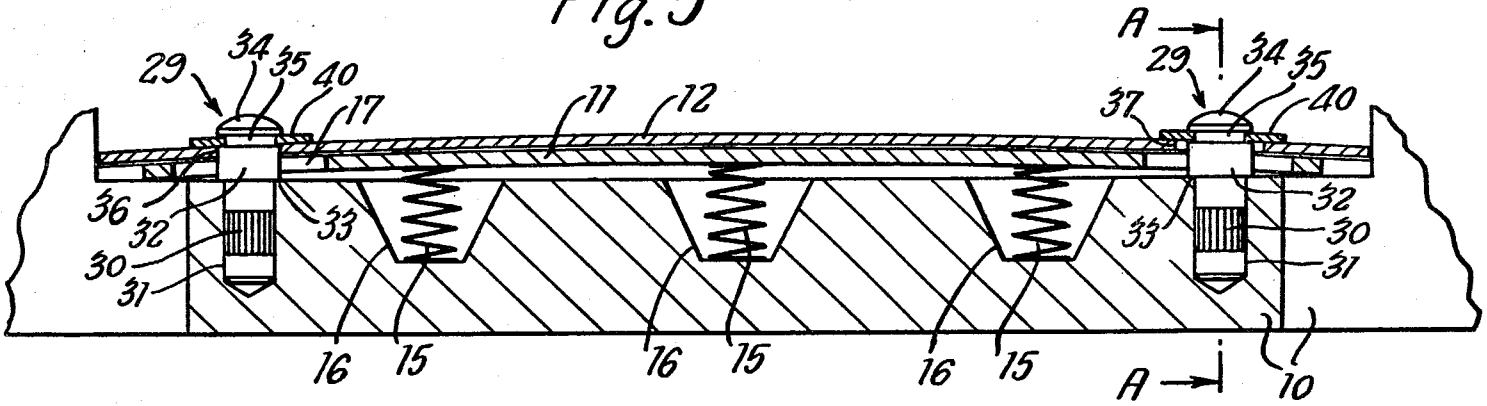
FIG. 5 is a longitudinal section, partially broken away, through a second embodiment of a hair clipper according to the invention.
Figure 6:
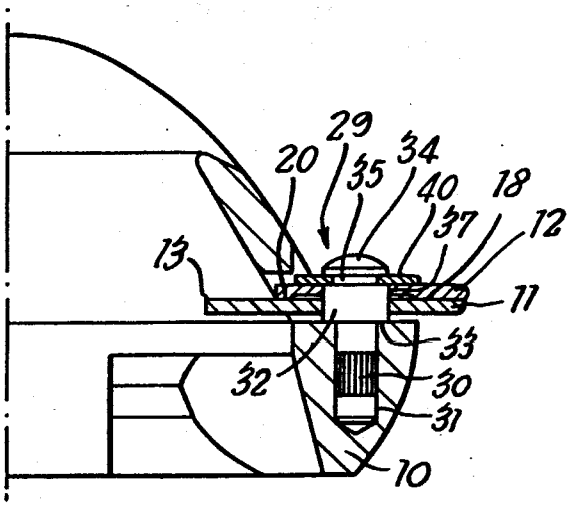
FIG. 6 is a section on line A—A of FIG. 5.

Referring now to FIGS. 5 and 6 there is shown a second embodiment of the invention. The following structure is similar to correspondingly referenced structure in FIGS. 1 to 4: the shaver body 10, the first movable cutter 11, the second fixed cutter 12, drive tap 13, coil springs 15, frusto-conical recesses 16, slots 17 in cutter 11, and strip portions 18 and 20 of cutter 11 that slide in engagement with cutter 12. As shown in FIG. 5, three spaced coil springs in three recesses 16 are provided resiliently to urge the first movable cutter 11 against the second fixed cutter 12, in place of the two coil springs of FIG. 1.

In this embodiment the reaction structure opposing the action of the three springs 15 comprises a pair of pins 29 and flat spring clips 40, the pins 29 also serving to locate the second fixed cutter longitudinally and laterally, and to guide the first cutter in its longitudinal reciprocation. The pins 29 are disposed near opposite ends of the cutter 12. Each pin has a shank having a central portion 30 ground to be a press fit in a bore 31 in the shaver body 10. The shank has an enlarged diameter upper portion 32 providing a shoulder 33 seated against the shaver body 10. Each pin has a head 34 and a neck 35 between the head and the portion 32. The spring clips 40 clip on the neck 35. The clips 40 are shaped part-rings and, being inherently resilient, can accommodate the blade curvature as seen in FIG. 5.

The pin portions 32 extend through the slots 17 of the first blade, to locate the first blade laterally and to guide it in its longitudinal reciprocation, and also extend through apertures through the end portions of the second blade 12. The left-hand aperture 36 in FIG. 5 is circular and locates the blade 12 longitudinally and laterally on the portion 32 of the pin 29. The right-hand aperture 37 in FIG. 5 is slightly elongate in the direction of the blade 12 to accommodate the upward resilient curvature of the blades. The aperture 37 also locates the blade 12 laterally on portion 32 of the pin 29.

Referring again to FIGS. 4 and 5, it will be appreciated that there is inevitably a small increase of pressure between the two cutters in the neighbourhood of the springs 15. This pressure increase is relatively very small as compared with the prior art case of two rectilinear cutters, as explained above. In a further modification even this very small pressure increase can be reduced by appropriate shaping of the cutters.

I claim:

1. A hair clipper comprising first and second elongate toothed cutters, said first cutter being adapted to be driven in sliding reciprocation, means for driving said cutters in mutual sliding longitudinal reciprocation to effect a hair clipping operation, both said cutters being inherently slightly resilient along their length, means for locating said second cutter in position longitudinally and laterally while permitting said second cutter to curve resiliently to assume a similar curvature to said first cutter, resilient means and reaction means, said resilient means acting on the first cutter to urge the first cutter against the second cutter, said reaction means acting on the second cutter to oppose the force due to said resilient means, said clipper having a body member provided with a bore, said locating means includes at least one piston, said piston working in said bore, and means urging said piston into engagement with said second cutter to act thereon away from said first cutter and against said reaction means, said resilient means and said reaction means providing a force couple that imparts a similar curvature to both said cutters along the direction of reciprocation, whereby to tend to render uniform the pressure distribution between the two urged together cutters.

2. A hair clipper according to claim 1 wherein said first cutter is provided with a slot extending lengthwise of said first cutter, and wherein said piston passes through said slot, whereby said piston also serves to locate the first cutter laterally and to guide the first cutter in its longitudinal reciprocation.

3. A hair clipper according to claim 1 wherein said reaction structure comprises a pair of pins, said pins disposed near opposite ends of the second cutter, said pins also serving as said locating means to locate the second cutter in position longitudinally and laterally, and said pins further serving to locate the first cutter laterally and to guide it in its longitudinal reciprocation.

4. A hair clipper according to claim 1 wherein the total force between said cutters is substantially 300 grams.

5. A hair clipper according to claim 1 wherein said resilient means comprises at least one spring, said at least one spring acting on the first cutter intermediate the ends of said first cutter, and wherein the reaction means includes substantially non-resilient reaction structure acting on each end portion of the second cutter.

6. A hair clipper according to claim 5 including at least two said springs acting in substantially the same direction and spaced apart from one another, said reaction means acting in substantially the opposite direction, whereby said curvature is in one sense from end to end of the cutters.

* * * * *